US010584883B2

(12) United States Patent
Brown

(10) Patent No.: US 10,584,883 B2
(45) Date of Patent: Mar. 10, 2020

(54) LOCATOR COVER FOR A COOKTOP APPLIANCE

(71) Applicant: Haier US Appliance Solutions, Inc., Wilmington, DE (US)

(72) Inventor: Justin Tyler Brown, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 275 days.

(21) Appl. No.: 15/658,448

(22) Filed: Jul. 25, 2017

(65) Prior Publication Data

US 2019/0032923 A1 Jan. 31, 2019

(51) Int. Cl.

| | |
|---|---|
| ***F24C 15/36*** | (2006.01) |
| ***F24C 15/00*** | (2006.01) |
| *F24C 15/10* | (2006.01) |
| *F24C 7/08* | (2006.01) |

(52) U.S. Cl.

CPC ..... *F24C 15/007* (2013.01); *F24C 15/00* (2013.01); *F24C 15/36* (2013.01)

(58) Field of Classification Search

CPC ..... F24C 15/36; F24C 15/007; F24C 15/107; F24C 7/083; F24C 7/00

USPC ..... 126/214 D, 221, 37 A, 42

See application file for complete search history.

(56) References Cited

U.S. PATENT DOCUMENTS

| | | | | |
|---|---|---|---|---|
| 727,251 | A * | 5/1903 | Allen | F24C 15/12 126/211 |
| 764,581 | A * | 7/1904 | Grove | F24C 15/10 126/221 |
| 3,198,189 | A * | 8/1965 | Oatley | A47J 36/34 126/211 |
| 4,361,132 | A * | 11/1982 | Adkins | F24C 15/14 126/221 |
| 5,353,781 | A * | 10/1994 | Calvillo | F24C 15/12 126/221 |
| 6,118,103 | A | 9/2000 | Vilato et al. | |
| 6,543,439 | B1 * | 4/2003 | Kollner | F24C 15/14 126/221 |
| 2013/0081608 | A1 * | 4/2013 | Bonadio | F24C 15/12 126/221 |
| 2015/0233584 | A1 * | 8/2015 | Mooney | F24C 15/107 126/50 |

(Continued)

FOREIGN PATENT DOCUMENTS

| | | | | |
|---|---|---|---|---|
| DE | 3427453 | A1 * | 2/1986 | F24C 15/12 |
| GB | 2090399 | A * | 7/1982 | F24C 15/102 |
| JP | 2005097108 | A | 4/2005 | |

*Primary Examiner* — Steven B McAllister
*Assistant Examiner* — Daniel E. Namay
(74) *Attorney, Agent, or Firm* — Dority & Manning, P.A.

(57) ABSTRACT

A cooktop includes a cooking surface and a heating element. A cover for the cooktop includes a top sheet extending between a left side and a right side and between a front side and a back side. A locator opening is defined in the top sheet. A first peripheral flange extends from one of the left side and the front side, and a second peripheral flange extends from one of the right side and the back side. A first plurality of cooling slots is between the top sheet and the first peripheral flange. A second plurality of cooling slots is between the top sheet and the second peripheral flange. The cover is configured to overlie the cooktop such that the locator opening corresponds to the heating element of the cooktop.

19 Claims, 5 Drawing Sheets

(56) References Cited

U.S. PATENT DOCUMENTS

2015/0323198 A1* 11/2015 Ratz ..... F24C 15/12
126/221

* cited by examiner

LOCATOR COVER FOR A COOKTOP APPLIANCE

FIELD OF THE INVENTION

The present subject matter relates generally to cooktop appliances and locator covers for cooktop appliances.

BACKGROUND OF THE INVENTION

Cooktop appliances generally include a cooking surface with one or more heating elements in or below the cooking surface. Cooking utensils or vessels, e.g., pots or pans, may be placed on or over the heating elements in order to cook food items in the cooking utensils. However, if the cooking utensil is not aligned with the heating element, the heating element may not be able to efficiently heat the food items in the utensil. In particular, smooth cooking surfaces, such as in a glass top cooktop appliance, may present difficulty for the user in properly locating and aligning the cooking utensil with the heating element. For example, if a user has limited vision, the user may have difficulty locating the desired heating element, e.g., in a cooktop appliance with a smooth cooking surface, where the visually impaired user may not be able to locate the utensil on the heating element using touch or feel.

Accordingly, locators which provide tactile response indicating the location of heating elements in or on a cooking surface, and in particular locators which provide a relatively cool surface as compared to the cooking surface, would be useful.

BRIEF DESCRIPTION OF THE INVENTION

Aspects and advantages of the invention will be set forth in part in the following description, or may be apparent from the description, or may be learned through practice of the invention.

In an exemplary embodiment, a cover for a cooktop is provided. The cooktop includes a cooking surface, a control, and a heating element in operative communication with the control. The heating element is configured to provide heat to the cooking surface. The cover defines a vertical direction, a lateral direction, and a transverse direction. The vertical, lateral, and transverse directions are mutually perpendicular. The cover includes a top sheet extending between a left side and a right side along the lateral direction and between a front side and a back side along the transverse direction. A locator opening is defined in the top sheet. A first peripheral flange extends along the vertical direction from one of the left side and the front side, and a second peripheral flange extends along the vertical direction from one of the right side and the back side. A first plurality of cooling slots is between the top sheet and the first peripheral flange. A second plurality of cooling slots is between the top sheet and the second peripheral flange. The cover is configured to overlie the cooktop such that the locator opening corresponds to the heating element of the cooktop.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
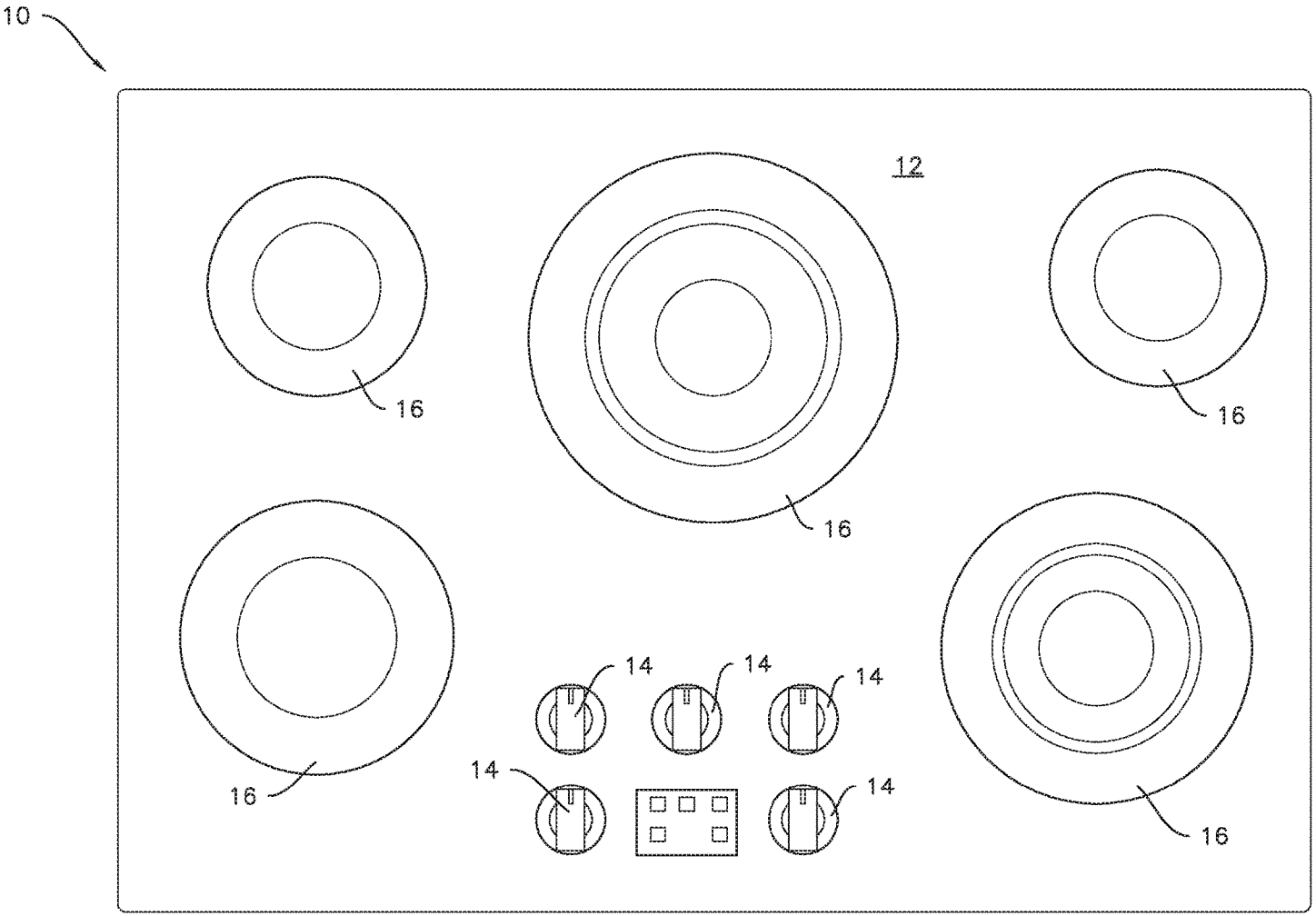
FIG. 1 provides a top view of a cooktop appliance such as may be used with one or more embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. Terms such as "left," "right," "front," "back," "top," or "bottom" are used with reference to the perspective of a user facing the cooktop. For example, a user stands in front of the cooktop appliance and a cover may be placed above the cooktop to facilitate ease of locating cooking utensils thereon.

Referring now to the drawings, FIG. 1 illustrates an exemplary embodiment of a cooktop 10 which may be used with embodiments of the present disclosure. Cooktop 10 may be, e.g., fitted integrally with a surface of a kitchen counter, or be a part of one or more oven appliances. Cooktop 10 includes a cooking surface 12 as well as one or more controls 14. In the illustrated exemplary embodiment, the one or more controls 14 are positioned on a single, continuous surface with the cooking surface 12. Alternatively, in other embodiments, the one or more controls 14 may be positioned separate from the cooking surface 12, e.g., on a back control panel of an oven appliance (not shown) or a front control panel of an oven appliance (not shown). In one exemplary embodiment, cooking surface 12 may be formed of ceramic glass. In other embodiments, however, cooking surface 12 may be formed of another suitable material, such as a metallic material (e.g., steel) or other suitable non-metallic material.

The cooking surface 12 of the cooktop 10 includes one or more heating elements 16 for use in, e.g., heating or cooking. For the embodiment depicted, the cooktop surface 12 includes five heating elements 16 of varying size. However, in other exemplary embodiments, the cooktop surface 12 may include any other suitable number of heating elements 16, any other suitable position for the heating elements 16, and/or any other suitable size for the heating elements 16. In some exemplary embodiments, the heating elements 16 may be resistance heating elements. Moreover, in still other exemplary embodiments, heating elements 16 may be inductive heating elements.

In use, a utensil or vessel holding food and/or cooking liquids (e.g., oil, water, etc.) may be placed onto cooking surface 12 at a location of any of heating elements 16. Heating elements 16 can be configured in various sizes so as to provide for the receipt of items to be heated, e.g., cooking utensils (pots, pans, etc.), of various sizes and configurations and to provide different heat inputs for such items. Heating elements 16 provide thermal energy to cooking utensils above cooking surface 12.

The amount of heat delivered by each heating element 16 on cooking surface 12 is controlled by a corresponding control 14. For the embodiment depicted, the cooktop 10 includes five controls 14, each control 14 associated with a respective heating element 16. For the embodiment depicted, each control of the one or more controls 14 is configured as a control knob, e.g., embodiments of which may include any configuration of rotary dial. In other exemplary embodiments, the one or more controls 14 may include push buttons, a touch screen, or any other suitable control element.

Figure 2:
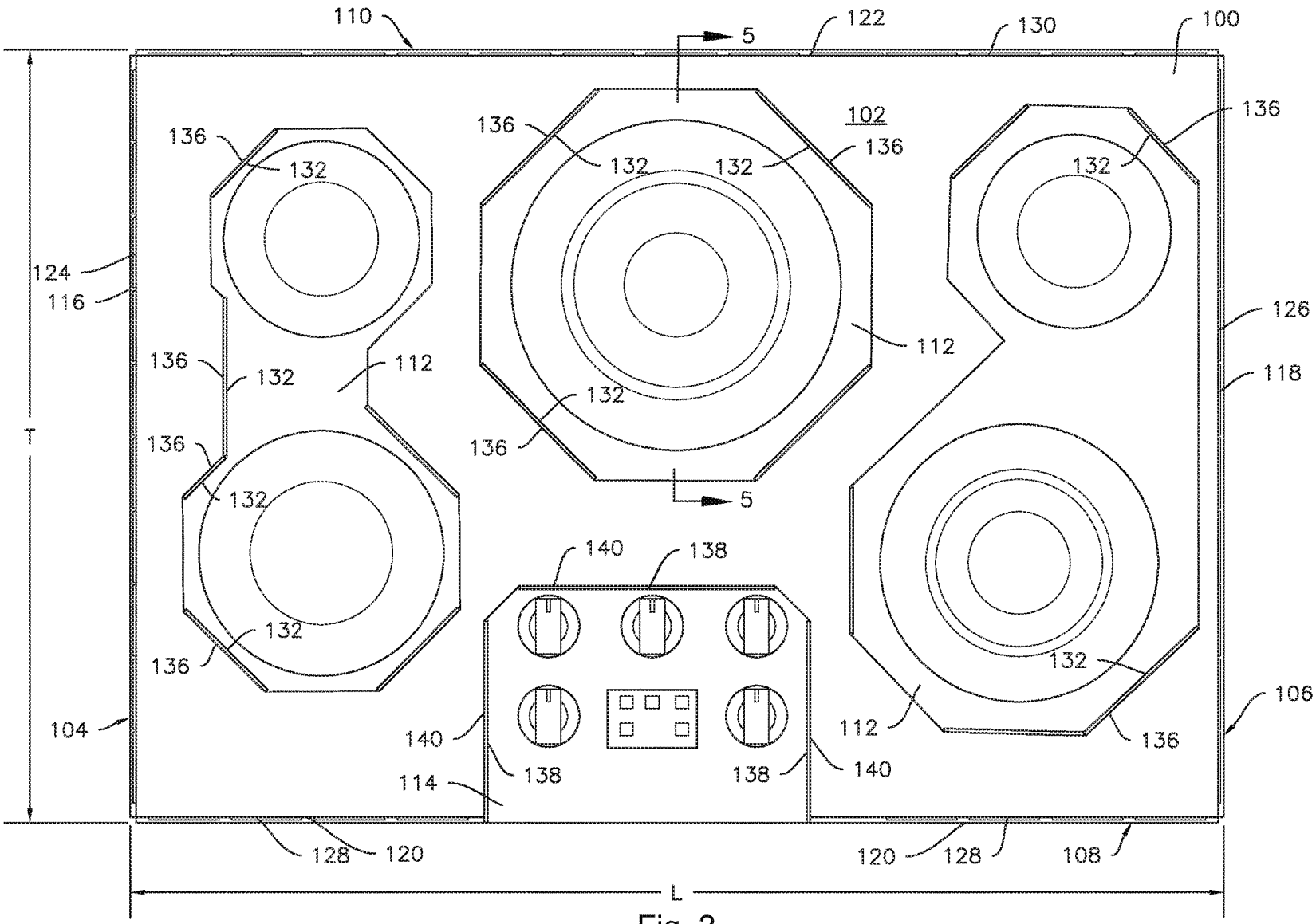
FIG. 2 provides a top view of an exemplary locator cover according to one or more embodiments of the present subject matter, positioned over the cooktop of FIG. 1.
Figure 3:
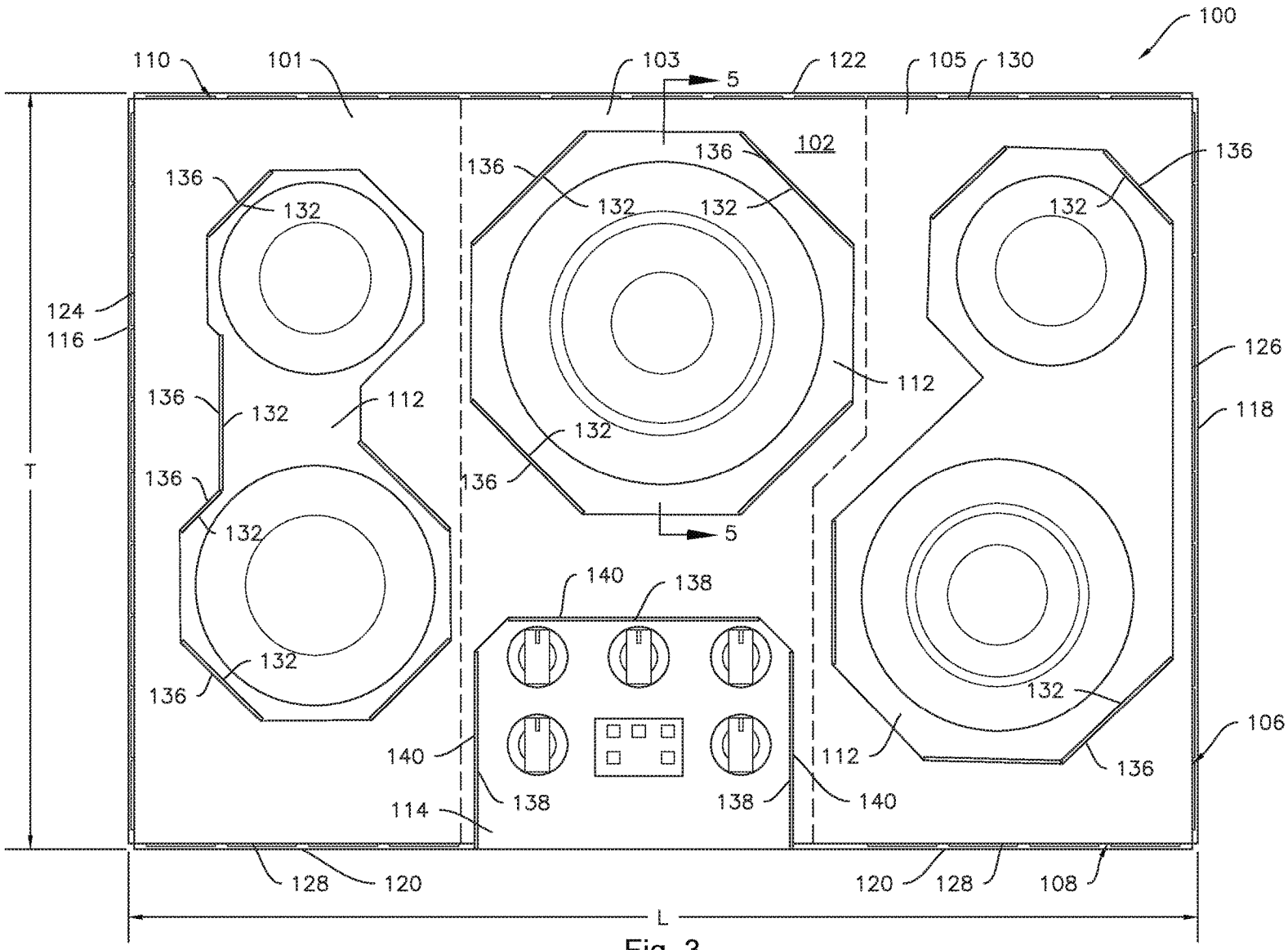
FIG. 3 provides a top view of an exemplary locator cover according to one or more embodiments of the present subject matter, positioned over the cooktop of FIG. 1.

Turning now to FIGS. 2 and 3, exemplary embodiments of a cover 100 are illustrated overlying the cooktop 10 of FIG. 1. In some embodiments, such as the example illustrated in FIG. 2, the cover 100 may be integrally formed as a one-piece unitary construction. In other embodiments, such as the example illustrated in FIG. 3, the cover 100 may include a plurality of detachable sections 101, 103, and 105. For example, the sections 101, 103, and 105 may include overlapping or interlocking tabs and/or slots (not shown) for detachably connecting the sections 101, 103, and 105. In such embodiments, the sections 101, 103, and 105 may be detached for cleaning, e.g., to more easily fit the sections 101, 103, and 105 into a dishwasher appliance. As illustrated in FIG. 3, in some embodiments, the plurality of detachable sections may include three detachable sections 101, 103, and 105. In other embodiments, any suitable number of detachable sections may be provided.

The cover 100 is configured to overlie the cooktop 10. That is, the cover 100 may define an outer perimeter that is generally the same shape as an outer perimeter of the cooktop 10, e.g., rectangular as illustrated in FIGS. 1 through 3, and the outer perimeter of the cover 100 may be about the same size or slightly larger than the outer perimeter of the cooktop 10. Thus, the cover 100 may be positioned over and around the cooktop 10, and in particular the cooking surface 12 of the cooktop 10.

The cover 100 may be formed of any suitable material. In some embodiments, the cover 100 may include a metallic material, such as stainless steel. In other embodiments, the cover 100 may include a temperature-resistant material such as fiberglass, high-temperature plastic, or ceramic materials.

Figure 4:
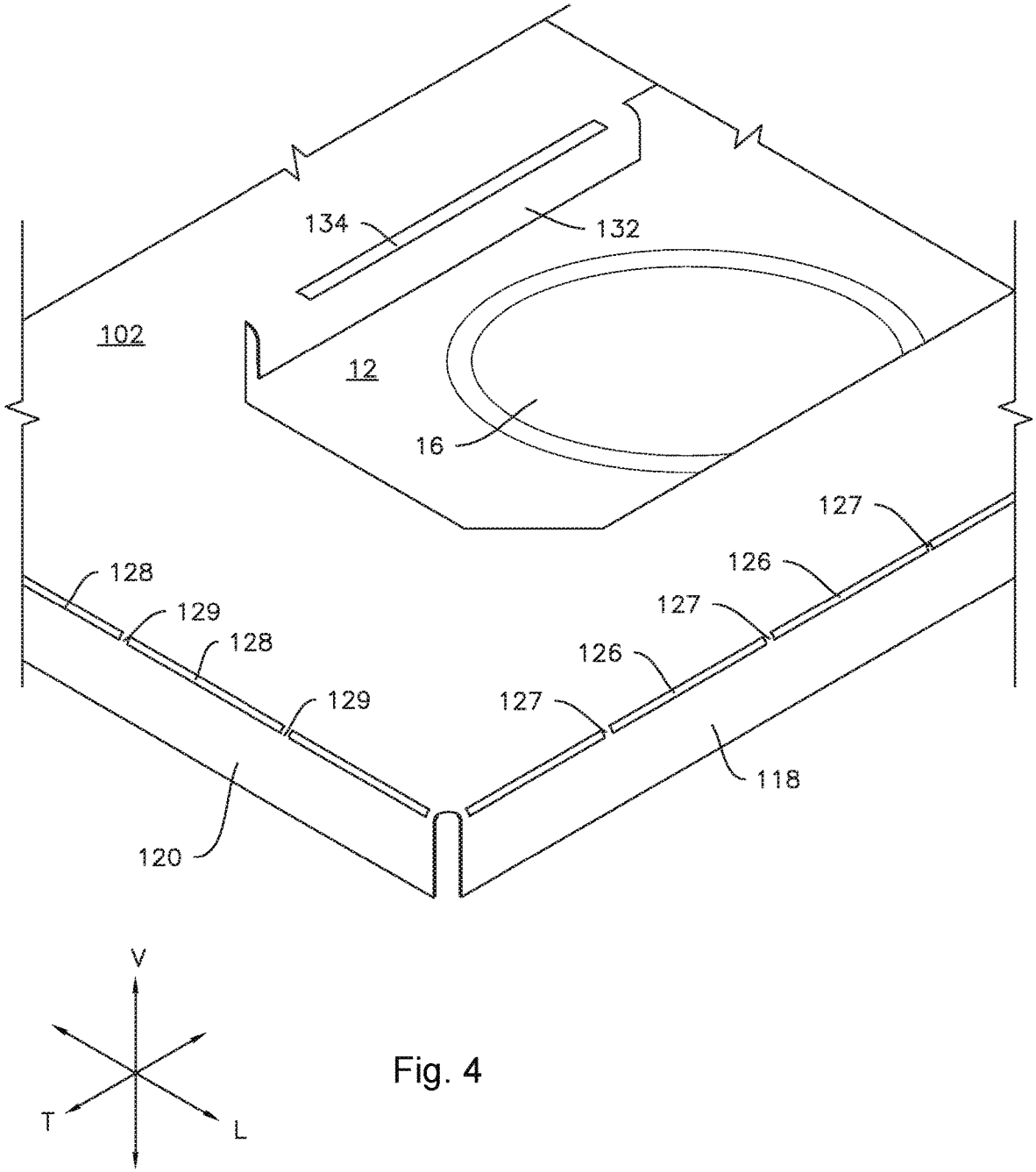
FIG. 4 provides a perspective view of a portion of the locator cover of FIG. 2 or FIG. 3.

Still with reference to FIGS. 2 and 3, the cover 100 defines a lateral direction L, a transverse direction T, and a vertical direction V (FIG. 4). The vertical, lateral, and transverse directions are mutually perpendicular. As illustrated, in one or more embodiments the cover 100 may include a top sheet 102. The top sheet 102 is generally planar, extending primarily within a plane defined by the lateral direction L and the transverse direction T, and the top sheet 102 has a vertical extent along the vertical direction V which is much smaller than either the lateral extent or the transverse extent of the top sheet 102. The top sheet 102 may extend between a left side 104 and a right side 106 along the lateral direction L and between a front side 108 and a back side 110 along the transverse direction T. When, as mentioned above, the cover 100 is placed over and around the cooktop 10, the top sheet 102 may be generally parallel to the cooking surface 12 and spaced apart from the cooking surface 12 along the vertical direction V.

At least one locator opening 112 is defined in the top sheet 102. The locator opening 112 is sized and positioned within the top sheet 102 to correspond to the heating element 16. Accordingly the cover 100 may be configured to overlie the cooktop 10 such that the locator opening 112 corresponds to the heating element 16 of the cooktop 10. In various embodiments, the cooktop 10 may include more than one heating element 16. In such embodiments, the cover 100 may include one or more than one locator opening. For example, the cooktop appliance 10 may include two heating elements 16, and the cover 100 may include one locator opening which generally corresponds to both heating elements 16. Another example is illustrated in FIGS. 2 and 3, where the cooktop 10 includes five heating elements 16 and the cover 100 includes three locator openings 112. Various combinations are possible, for example, a locator opening 112 may correspond to a single heating element 16, as in the central heating element 16 and corresponding central locator opening 112 in FIGS. 2 and 3, or a locator opening 112 may correspond to two or more adjacent heating elements 16, e.g., as shown in the left and right side locator openings 112 in FIGS. 2 and 3.

The locator opening(s) 112 may be slightly larger than the respective heating element(s) 16. The one or more locator openings 112 may have any suitable shape, such as polygonal, curved, or may include a combination of linear and curved sides. In the illustrated embodiments of FIGS. 2 and 3, each locator opening 112 comprises a polygonal shape with all linear sides. In some embodiments, the locator opening 112 includes at least one linear side 136. In use, when the cover 100 overlies the cooktop 10, a user may place one or more cooking utensils through the locator opening(s) 112 to facilitate ease of positioning and aligning the utensil(s) on the heating element(s) 16. Such cooking utensils generally define a curved shape. Providing the locator opening 112 slightly larger than the corresponding heating element 16 and at least one linear side 136 on the locator opening 112 may advantageously minimize contact area between the curved cooking utensil(s) and the sides of the locator opening 112 to reduce or avoid heat transfer from the hot cooking utensil to the cover 100, in particular the top sheet 102.

As seen in FIGS. 2 and 3, the cover 100 may include a control opening 114 defined in the top sheet 102. In such embodiments, the cover 100 may be configured to overlie the cooktop 10 such that the control opening 110 corresponds to the control(s) 14 of the cooktop such that a user may access the control(s) 14 with the cover 100 overlying the cooktop 10. The control opening comprises at least one inner flange 138 extending along the vertical direction V from a linear side 140 of the control opening 114.

The cover 100 may further include one or more peripheral flanges extending along the left side 104, the right side 106, front side 108, and/or back side 110. Generally, the one or more peripheral flanges extend along the vertical direction V from each respective side of the top sheet 102. Accordingly, the one or more peripheral flanges may provide support to the cover 100 and provide a raised elevation to the cover 100, e.g., the cover 100 may be positioned over and around the cooktop 10 such that the vertical extent of the peripheral flanges permits the top sheet 102 to be spaced apart from the cooking surface 12 along the vertical direction V. The one or more peripheral flanges may generally be provided on two opposing sides of the top sheet 102, e.g., the left side 104 and right side 106 or the front side 108 and back side 110. For example, in some embodiments, the cover 100 may include a left peripheral flange 116 and a right peripheral flange 118. In other exemplary embodiments, the cover 100 may include a front peripheral flange 120 and a back peripheral flange 122. In some embodiments, the cover 100 may include all four of the right peripheral flange 116, the left peripheral flange 118, the front peripheral flange 120 and the back peripheral flange 122.

Thus, in various embodiments, the cover 100 may include a first peripheral flange and a second peripheral flange extending from the left side 104 and the right side 106, or the first peripheral flange and the second peripheral flange may extend from the front side 108 and the back side 110. For example, the cover 100 may include a first peripheral flange 116 extending along the vertical direction V from the left side 104 of the cover 100 and a second peripheral flange 118 extending along the vertical direction V from the right side 106 of the cover 100. In such embodiments, the cover 100 may further include a third peripheral flange 120 extending along the vertical direction V from the front side 108 of the cover 100 and a fourth peripheral flange 122 extending along the vertical direction V from the back side 110 of the cover 100. In another example, the cover 100 may include a first peripheral flange 120 extending along the vertical direction V from the front side 108 of the cover 100 and a second peripheral flange 122 extending along the vertical direction V from the back side 110 of the cover 100. In such embodiments, the left peripheral flange 116 and the right peripheral flange 118 may also be provided, in which case the left peripheral flange 116 and the right peripheral flange 118 may be referred to as a third peripheral flange and a fourth peripheral flange, respectively.

As illustrated in FIGS. 2 and 3, each peripheral flange 116, 118, 120, and 122 may be positioned at or along an outermost edge of the top sheet 102. In some embodiments, each peripheral flange 116, 118, 120, and 122 may be generally coextensive with the corresponding side 104, 106, 108, and 110 of the top sheet 102. Thus, some exemplary embodiments may include a first peripheral flange 116 which extends along the vertical direction V from the left side 104 of the top sheet 102 and a second peripheral flange 118 which extends along the vertical direction V from the right side 106 of the top sheet 102. In such embodiments, the first peripheral flange 116 may be generally coextensive with the left side 104 of the top sheet 102 along the transverse direction T and the second peripheral flange 118 may be coextensive with the right side 106 of the top sheet 102 along the transverse direction T. In other exemplary embodiments, the front peripheral flange 120 may be the first peripheral flange and may be generally coextensive with the front side 108 along the lateral direction L and the back peripheral flange 122 may be the second peripheral flange and may be generally coextensive with the back side 110 along the lateral direction L. As used herein, terms of approximation such as "about" or "generally" include within ten percent greater or less than the stated value. For example, a peripheral flange being "generally coextensive" with a side of the top sheet may include a length of the peripheral flange from ninety percent to one hundred and ten percent of a corresponding length of the side of the top sheet, e.g., along the lateral direction L or the transverse direction T. Additionally, such terms when used in connection with an angle or direction include within ten degrees greater or less than the stated angle or direction. For example, "generally perpendicular" may include angles from eighty to one hundred degrees.

A plurality of cooling slots may be provided between each peripheral flange and a corresponding side of the top sheet 102. Such cooling slots may advantageously limit or reduce heat transfer from the cooking surface 12 to the cover 100 and in particular the top sheet 102, e.g., by reducing the area of continuous material between a portion of the cover 100 proximate to the cooking surface 12, e.g., the peripheral flanges 116, 118, 120, and 122, and the top sheet 102 to reduce conductive heat transfer from the peripheral flanges 116, 118, 120, and 122 to the top sheet 102 and/or by promoting a cooling flow of ambient air through the cooling slots. For example, as illustrated in FIGS. 2 and 3, a first plurality of cooling slots 124, a second plurality of cooling slots 126, a third plurality of cooling slots 128, and a fourth plurality of cooling slots 130 may be provided between the peripheral flanges 116, 118, 120, and 122, respectively, and the top sheet 102. In various embodiments, the cover 100 may include a first plurality of cooling slots, e.g., one of the left cooling slots 124 or the front cooling slots 128, between the top sheet 102 and the first peripheral flange, e.g., a corresponding one of the left peripheral flange 116 or the front peripheral flange 120, and a second plurality of cooling slots, e.g., one of the right cooling slots 126 or back cooling slots 130, between the top sheet 102 and the second peripheral flange, e.g., a corresponding one of the right peripheral flange 118 or the back peripheral flange 122. Such embodiments may further include a third peripheral flange, e.g., the other of the left peripheral flange 116 or the front peripheral flange 120, and a fourth peripheral flange, e.g., the other of the right peripheral flange 118 or the back peripheral flange 122, with a third plurality of cooling slots, e.g., the other of the left cooling slots 124 or the front cooling slots 128, between the top sheet 102 and the third peripheral flange 116 or 120, and a fourth plurality of cooling slots, e.g., the other of the right cooling slots 126 or back cooling slots 130, between the top sheet 102 and the fourth peripheral flange 118 or 122.

Examples of the peripheral flanges and cooling slots are best seen in FIG. 4, which provides an enlarged perspective view of a portion of the cover 100 overlying the cooktop 10. As seen in FIG. 4, the front peripheral flange 120 is separated from the top sheet 102 by a plurality of cooling slots 128. The cooling slots 128 extend generally along the lateral direction L and along the border between the front peripheral flange 120 and the top sheet 102 at the front side 108 of the top sheet 102. Also as seen in FIG. 4, a plurality of cooling slots 126 may be provided between the left peripheral flange 118 and the top sheet 102 generally along the border of the top sheet 102 and the left peripheral flange 118 at the left side 106 of the top sheet 102. As noted above, terms of approximation when used herein in the context of an angle or direction include within ten degrees of the stated angle or direction. For example, the cooling slots which extend "generally along" the border between the peripheral flange and top sheet may form any angle between zero degrees and ten degrees (in any direction) with the border. The left peripheral flange 116 and left plurality of cooling slots 124 as well as the back peripheral flange 122 and the back plurality of cooling slots 130 may be similarly configured as shown and described herein with respect to the flanges 118 and 120 and cooling slots 126 and 128 illustrated in FIG. 4.

One or more of the peripheral flanges 116, 118, 120, and 122, e.g., a first peripheral flange, may be connected to the top sheet 102 via a plurality of tabs, e.g., a first plurality of tabs, and the respective cooling slots 124, 126, 128, and 140 may extend between adjacent tabs of the plurality of tabs, e.g., the first plurality of tabs. For example, as illustrated in FIG. 4, each of the front peripheral flange 120 and the right peripheral flange 118 may be connected to the top sheet 102 by tabs 129 and 127, respectively. In such embodiments, each cooling slot of the respective plurality of cooling slots may extend between adjacent tabs of the plurality of tabs. For example, as illustrated in FIG. 4, each cooling slot 128 of the front plurality of cooling slots 128 extends between adjacent tabs 129 of the front plurality of tabs 129, likewise, each cooling slot 126 of the left plurality of cooling slots 126 extends between adjacent tabs 127 of the left plurality of tabs 127. Additionally, the left peripheral flange 116 and left plurality of cooling slots 124 as well as the back peripheral flange 122 and back plurality of cooling slots 130 may be similarly configured as described herein and illustrated in FIG. 4 with respect to the flanges 118 and 120, cooling slots 126 and 128, and tabs, 127 and 129.

Figure 5:
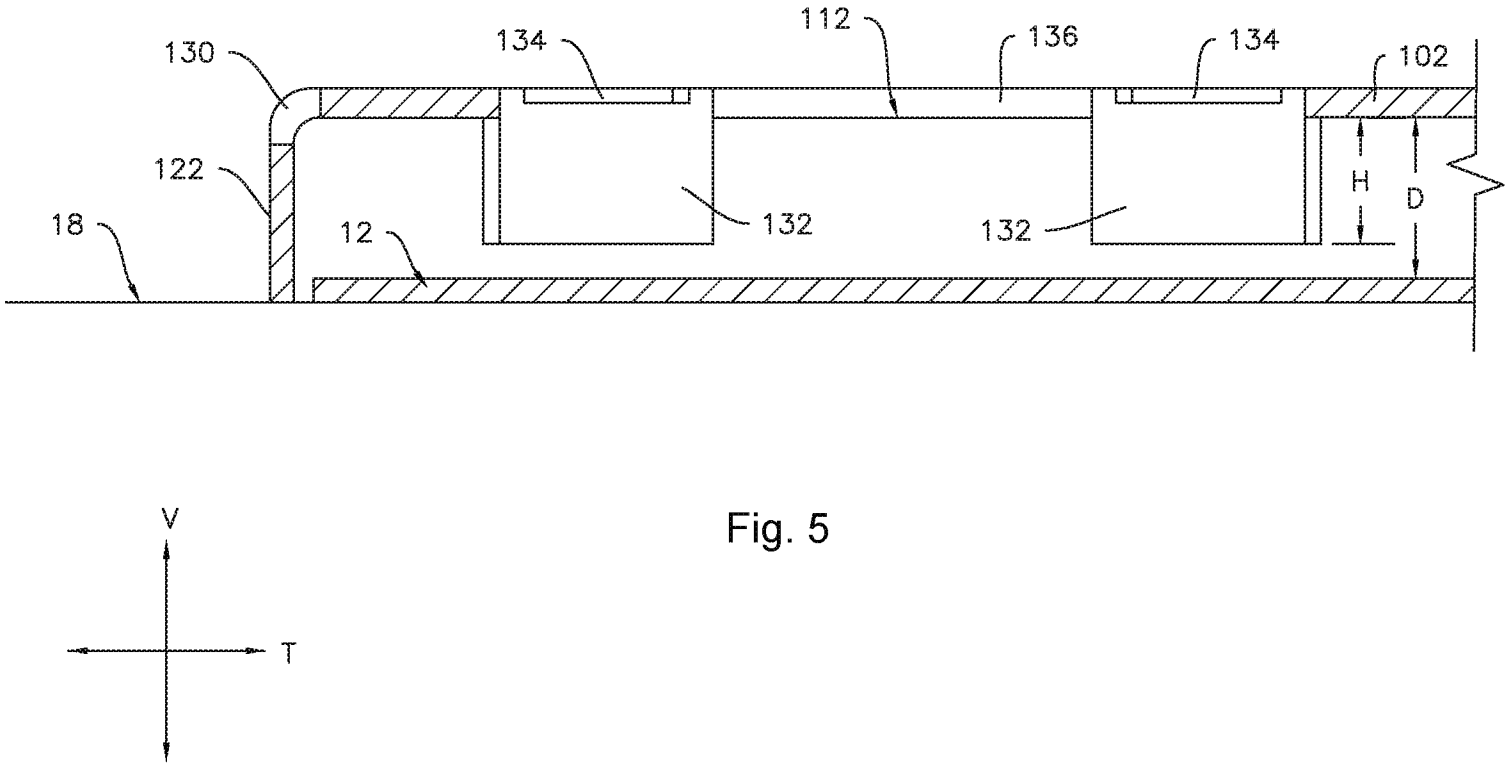
FIG. 5 provides a section view of a portion of the locator cover of FIG. 2 or FIG. 3.

Turning now to FIGS. 4 and 5, the locator opening 112 may also include at least one auxiliary flange 132 extending along the vertical direction V from a linear side 136 of the locator opening 112. One or more cooling slots 134 may extend generally along a border between the auxiliary flange 132 and the top sheet 102, in a similar manner as described with respect to the peripheral flanges and associated cooling slots. As best seen in FIG. 5, the at least one auxiliary flange 132 defines a height H along the vertical direction V. As shown, the cover 100 may be configured to overlie the cooktop 10 such that the top sheet 102 is spaced apart from the cooking surface 12 of the cooktop 10 along the vertical direction V by a depth D. The depth D may be provided, e.g., by the peripheral flanges, such as back peripheral flange 122 illustrated in FIG. 5, extending along the vertical direction V from at least two sides of the top sheet 102. In such embodiments, the height H of the at least one auxiliary flange 132 is preferably less than the depth D. Accordingly, heat transfer from the cooking surface 12 to the top sheet 102 via the at least one auxiliary flange 132 may be reduced or avoided when the at least one auxiliary flange 132 does not contact the cooking surface 12 while the cover 100 overlies the cooktop 10. In some embodiments, the locator opening 112 may include at least two linear sides 136 with at least one auxiliary flange 132 extending along the vertical direction V from one of the at least two linear sides 136 of the locator opening 112. In some embodiments, there may be fewer auxiliary flanges 132 than linear sides 136 of the locator opening 112. In various embodiments, the locator opening 112 may include various combinations of curved and linear sides, as described above. Further, the locator opening 112 may include various combinations of linear sides 136 and auxiliary flanges 132. For example, as illustrated in FIGS. 2 and 3, various embodiments of the locator opening 112 may include eight linear sides 136 and four auxiliary flanges 132, sixteen linear sides 136 and six auxiliary flanges 132, or eleven linear sides 136 and five auxiliary flanges 132. Additionally, various other combinations or ratios of linear sides 136 and auxiliary flanges 132 are possible.

As shown in FIG. 5, the peripheral flanges of the cover 100 may be configured to engage an external surface 18 proximate to the cooking surface 12 of the cooktop 10 when the cover 100 overlies the cooktop 10. As mentioned above, a perimeter of the cover 100 may be slightly larger than a perimeter of the cooktop 10 to permit cover 100 to be placed around the cooktop 10. For example, as illustrated in FIG. 5, the perimeter of the cover 100 is slightly larger than the perimeter of the cooktop 10 such that peripheral flanges of the cover 100, e.g., back peripheral flange 122, which may be positioned along the perimeter of the cover 100, can be positioned around the cooktop 10. Also as mentioned above, cooktop 10 may be fitted integrally with a surface of a kitchen counter, or be a part of one or more oven appliances. In various embodiments, the external surface 18 may be a top surface of the kitchen counter, and the cooktop 10 may be fitted integrally with the kitchen counter or the cooktop 10 may be part of an oven appliance positioned next to the kitchen counter. FIG. 5 illustrates a particular example of back peripheral flange 122 engaging the kitchen counter surface 18 to provide structural support to the cover 100 which overlies the cooktop 10 while the back peripheral flange 122 also provides a vertical spacing between the cooking surface 12 and the top sheet 102 of the cover 100. The front peripheral flange 120 may also be configured similarly to the back peripheral flange 122 as shown in FIG. 5. Additionally, in some embodiments, the left peripheral flange 116 and the right peripheral flange 118 may also or instead engage the external surface 18, in a similar manner as illustrated with respect to back peripheral flange 122 in FIG. 5. Thus, in some embodiments, the cover 100 may include a first peripheral flange (e.g., one of left peripheral flange 116 or front peripheral flange 120) and a second peripheral flange (e.g., a corresponding one of right peripheral flange 118 or back peripheral flange 122) configured to engage the external surface 18 proximate to the cooking surface 12 of the cooktop 10 when the cover 100 overlies the cooktop 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cover for a cooktop, the cooktop comprising a cooking surface, a control, and a heating element in operative communication with the control, the heating element configured to provide heat to the cooking surface, the cover defining a vertical direction, a lateral direction, and a transverse direction, the vertical, lateral, and transverse directions being mutually perpendicular, the cover comprising:

a top sheet extending between a left side and a right side along the lateral direction and between a front side and a back side along the transverse direction;

a locator opening defined in the top sheet;

a first peripheral flange extending along the vertical direction from one of the left side and the front side;

a second peripheral flange extending along the vertical direction from one of the right side and the back side;

a first plurality of cooling slots between the top sheet and the first peripheral flange, the first plurality of cooling slots extending along one of the transverse direction or lateral direction and aligned consecutively along one of the transverse direction or lateral direction; and a second plurality of cooling slots between the top sheet and the second peripheral flange, the second plurality of cooling slots extending along one of the transverse direction or lateral direction and aligned consecutively along one of the transverse direction or lateral direction;

wherein the cover is configured to overlie the cooktop such that the locator opening corresponds to the heating element of the cooktop.

2. The cover of claim 1, wherein the first peripheral flange and the second peripheral flange are configured to engage an external surface proximate to the cooking surface of the cooktop when the cover overlies the cooktop.

3. The cover of claim 1, further comprising a third peripheral flange extending along the vertical direction from the other of the left side and the front side, a fourth peripheral flange extending along the vertical direction from the other of the right side and the back side, a third plurality of cooling slots between the top sheet and the third peripheral flange, and a fourth plurality of cooling slots between the top sheet and the fourth peripheral flange.

4. The cover of claim 1, wherein the first peripheral flange extends along the vertical direction from the left side of the top sheet and the second peripheral flange extends along the vertical direction from the right side of the top sheet.

5. The cover of claim 4, wherein the first peripheral flange is coextensive with the left side of the top sheet along the transverse direction and the second peripheral flange is coextensive with the right side along the transverse direction.

6. The cover of claim 1, wherein the first peripheral flange is connected to the top sheet via a first plurality of tabs, each cooling slot of the first plurality of cooling slots extends between adjacent tabs of the first plurality of tabs, the second peripheral flange is connected to the top sheet via a second plurality of tabs, and each cooling slot of the second plurality of cooling slots extends between adjacent tabs of the second plurality of tabs.

7. The cover of claim 1, wherein the locator opening comprises a polygonal shape.

8. The cover of claim 1, wherein the locator opening comprises at least one auxiliary flange extending along the vertical direction from a linear side of the locator opening.

9. The cover of claim 8, wherein the at least one auxiliary flange defines a height along the vertical direction, the cover is configured to overlie the cooktop such that the top sheet is spaced apart from the cooking surface of the cooktop along the vertical direction by a depth, and the height of the at least one auxiliary flange is less than the depth.

10. The cover of claim 1, wherein the locator opening comprises at least two linear sides, at least one auxiliary flange extending along the vertical direction from one of the at least two linear sides of the locator opening, and there are fewer auxiliary flanges than linear sides.

11. The cover of claim 1, further comprising a control opening defined in the top sheet, wherein the cover is configured to overlie the cooktop such that the control opening corresponds to the control of the cooktop.

12. The cover of claim 11, wherein the control opening comprises at least one inner flange extending along the vertical direction from a linear side of the control opening.

13. The cover of claim 1, wherein the cover is formed as a unitary construction.

14. The cover of claim 1, wherein the cover comprises a plurality of detachable sections.

15. The cover of claim 1, wherein the cover comprises a metallic material.

16. A cover for a cooktop, the cooktop comprising a cooking surface, a control, and a heating element in operative communication with the control, the heating element configured to provide heat to the cooking surface, the cover defining a vertical direction, a lateral direction, and a transverse direction, the vertical, lateral, and transverse directions being mutually perpendicular, the cover comprising:

a top sheet extending between a left side and a right side along the lateral direction and between a front side and a back side along the transverse direction;

a locator opening defined in the top sheet;

a first peripheral flange extending along the vertical direction from the left side;

a second peripheral flange extending along the vertical direction from the right side;

a first plurality of cooling slots between the top sheet and the first peripheral flange, the first plurality of cooling slots extending along the transverse direction and aligned consecutively along the transverse direction; and a second plurality of cooling slots between the top sheet and the second peripheral flange, the second plurality of cooling slots extending along the transverse direction and aligned consecutively along the transverse direction;

wherein the cover is configured to overlie the cooktop such that the locator opening corresponds to the heating element of the cooktop.

17. The cover for a cooktop as in claim 16, wherein the first plurality of cooling slots is located along a border of the first peripheral flange and the top sheet.

18. A cover for a cooktop, the cooktop comprising a cooking surface, a control, and a heating element in operative communication with the control, the heating element configured to provide heat to the cooking surface, the cover defining a vertical direction, a lateral direction, and a transverse direction, the vertical, lateral, and transverse directions being mutually perpendicular, the cover comprising:

a top sheet extending between a left side and a right side along the lateral direction and between a front side and a back side along the transverse direction;

a locator opening defined in the top sheet;

a first peripheral flange extending along the vertical direction from the front side;

a second peripheral flange extending along the vertical direction from the back side;

a first plurality of cooling slots between the top sheet and the first peripheral flange, the first plurality of cooling slots extending along the lateral direction and aligned consecutively along the lateral direction; and a second plurality of cooling slots between the top sheet and the second peripheral flange, the second plurality of cooling slots extending along the lateral direction and aligned consecutively along the lateral direction;

wherein the cover is configured to overlie the cooktop such that the locator opening corresponds to the heating element of the cooktop.

19. The cover for a cooktop as in claim 18, wherein the first plurality of cooling slots is located along a border of the first peripheral flange and the top sheet.

* * * * *